US006062702A

United States Patent [19]

Krietzman

[11] Patent Number: 6,062,702

[45] Date of Patent: May 16, 2000

[54] LASER LIGHT

[76] Inventor: Mark Howard Krietzman, 25550 Hawthorne Blvd. Suite 101, Torrance, Calif. 90505

[21] Appl. No.: 08/918,514

[22] Filed: Aug. 21, 1997

Related U.S. Application Data

[60] Provisional application No. 60/043,192, Apr. 16, 1997.

[51] Int. Cl.[7] ..... F21K 7/00; F21L 7/00

[52] U.S. Cl. ..... 362/158; 362/259; 362/184; 362/205

[58] Field of Search ..... 362/158, 184, 362/205, 206, 259, 203

[56] References Cited

U.S. PATENT DOCUMENTS

| | | | |
|---|---|---|---|
| 4,680,682 | 7/1987 | Parker | 362/158 |
| 5,343,376 | 8/1994 | Huang | 362/259 |
| 5,349,506 | 9/1994 | Maglica | 362/158 |
| 5,349,507 | 9/1994 | Parker | 362/158 |

*Primary Examiner*—Thomas M. Sember
*Attorney, Agent, or Firm*—Mark Krietzman

[57] ABSTRACT

A novel hand held waterproof or submersible laser illumination device which provides for prolonged precise controlled illumination. The present invention also provides for a combination generalized illumination and selectable precise laser outputs.

29 Claims, 3 Drawing Sheets

LASER LIGHT

RELATED APPLICATIONS

The within invention claims the benefit, under Title 35, United States Code 119 (e), of two Provisional Application: 60/043,192, filed Apr. 16, 1997.

BACKGROUND OF THE INVENTION

TECHNICAL FIELD OF THE INVENTION

This present invention relates to hand held lighting devices, and more particularly to a novel hand held waterproof or submersible laser light and laser flashlight, for illumination, communication, targeting, presentations, and measurement.

BACKGROUND

Those experienced with diving will recall that inexpensive underwater communication is normally a combination of writing tablets, hand signals and nods. Watertight flashlights may solve some problems but do not provide the precise highly visible illumination and communication a submersible laser emitting illuminator yields.

Watertight flashlights are useful to ensure the integrity and reliability of operation in wet and harsh environments. In the underwater environment the users ability to see clearly, communicate verbally, and dexterity are limited by the breathing equipment and the dampening effect of the water. Also, often in non-underwater environments verbal communication may be restricted or limited.

A submersible laser light is visible in day and night situations and enhances a divers ability to communicate. Providing selectable laser outputs further enhances clear communication and illumination.

In both diving and non-diving situations a flashlight which produces both a general area of illumination and a precise controlled laser illumination would be useful.

The present invention provides a novel illumination system for prolonged precise selectable laser communication and precise controlled laser illumination. The present invention also provides for a combination generalized illumination and precise laser illumination.

SUMMARY OF INVENTION

Accordingly, it is an object of the invention to provide a novel hand held laser light.

It is yet another object of the invention to provide a novel hand held submersible laser light.

It is yet another object of the invention to provide a novel hand held submersible laser illuminator which can transmit a narrow focused output, underwater, to activate a remote wavelength specific submersible photoactive sensor with audible output.

It is yet another object of the invention to provide a novel hand held submersible laser light with selectable diffuse output.

It is yet another object of the invention to provide a novel hand held submersible laser light with selectable pattern output.

It is yet another object of the invention to provide a novel hand held submersible flashlight and laser light.

It is yet another object of the invention to provide a novel hand held flashlight and laser light.

It is yet another object of the invention to provide a novel hand held all weather flashlight and laser light.

It is yet another object of the invention to provide a novel hand held submersible flashlight and laser light with selectable diffuse laser output.

It is yet another object of the invention to provide a novel hand held submersible flashlight and laser light with selectable pattern laser output.

The features of the invention believed to be novel are set forth with particularity in the appended claims. The invention itself, however, both as to configuration, and method of operation, and the advantages thereof, may be best understood by reference to the following descriptions taken in conjunction with the accompanying drawings.

MODES FOR CARRYING OUT THE INVENTION

Figure 1A:
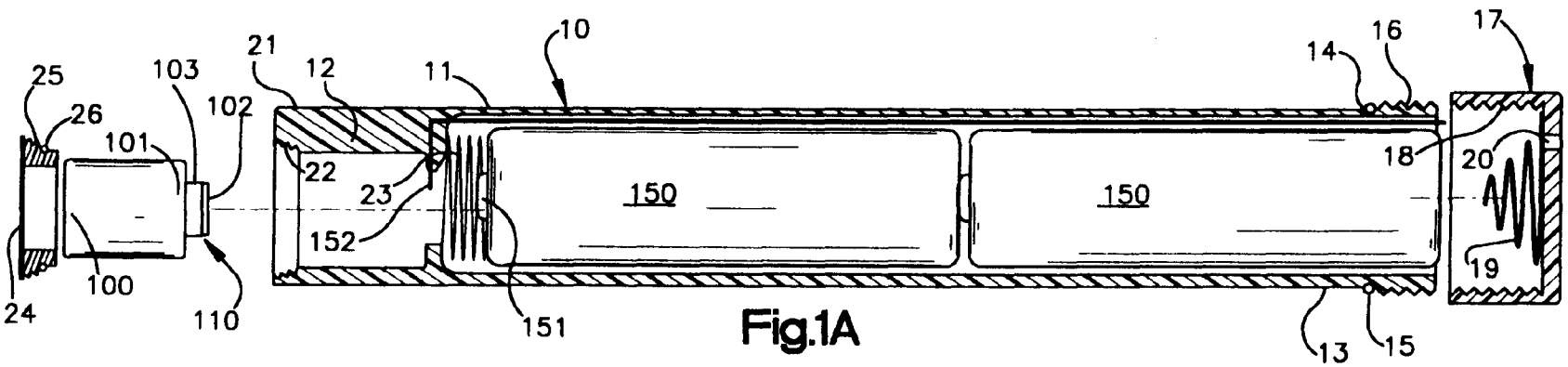
FIG. 1A illustrates a cut-away side assembly view of the preferred embodiment of the laser light.

Referring now to the drawings, there is illustrated in FIG. 1A a cut-away assembly side view of the preferred embodiment of the laser light generally designated 10.

The generally tubular housing 11 is of a size and shape which allows the insertion of one or more a batteries 150, a removable solid state laser diode 100, (held in place within a circular diode guide 12 formed within the housing), and a front spacing spring 151 for controlling battery 150 contact with the laser emitting diode 100.

The batteries 150 are inserted into the rear of the housing 13. The outer wall of the rear of the housing 13 is circularly groved 14 to secure a rubber or silicone O-ring 15 firmly in place and has circular coarse threads 16. An end cap 17 with internal threads 18 corresponding to the course threads 16 is screwed on to the housing 13 over the O-ring 15 to seal the device 10. The rear-cap 17 also contains a contact spring 19 for controlling battery 150 contact with the laser emitting diode 100 and a one-way pressure relief valve 20 to vent battery 150 gases.

At the front end of the housing 21, the diode guide 12 is internally threaded 22. The diode guide 12 abuts a diode stop 23 which is used to inhibit rearward movement of the laser emitting diode 100.

The laser emitting diode 100 is readily available and is known art. The diode comprises a laser beam module with a control circuit. Since the laser emitting diode is well known in the art, it is unnecessary to present a detailed statement of its construction in the present invention.

For the preferred embodiment a laser emitting source in the visible range is used. The most compact source is a solid-state diode in the 532–690 nm range. Diode-pumped, CW diode, Q-switched diode, solid-state, solid-state CW, solid-state Q-switched, gas, dye, ion, or rare-earth element laser emitting sources may be used in place of the solid state diode when appropriate for the intended usage. For surveillance uses, search and rescue or other applications which use night vision or machine vision coupled with a non-visible spectrum illumination a laser emitting diode in the x-ray, ultraviolet or infrared spectrum may be substituted for the visible spectrum laser emitting diode.

Extending from the rear 101 of the laser emitting is a first conductive contact 102 and a second conductive contact 103 both affixed to a cylindrical contact neck 110. Within the housing 11 a rear contact strip 152 of a conductive material is affixed axially within the device.

To seal the diode 100 within the housing 11 and allow the light emitted therefrom to exit the housing 11 a transparent lens cap 24 is provided. The transparent lens cap 24 is finely threaded 25 to match the threads 22 provided within the diode guide 12 and is also circularly groved (not shown) to secure a front O-ring 26. When screwed into the diode guide 12 the transparent lens cap 24 and O-ring 26 form a watertight seal.

Figure 1B:
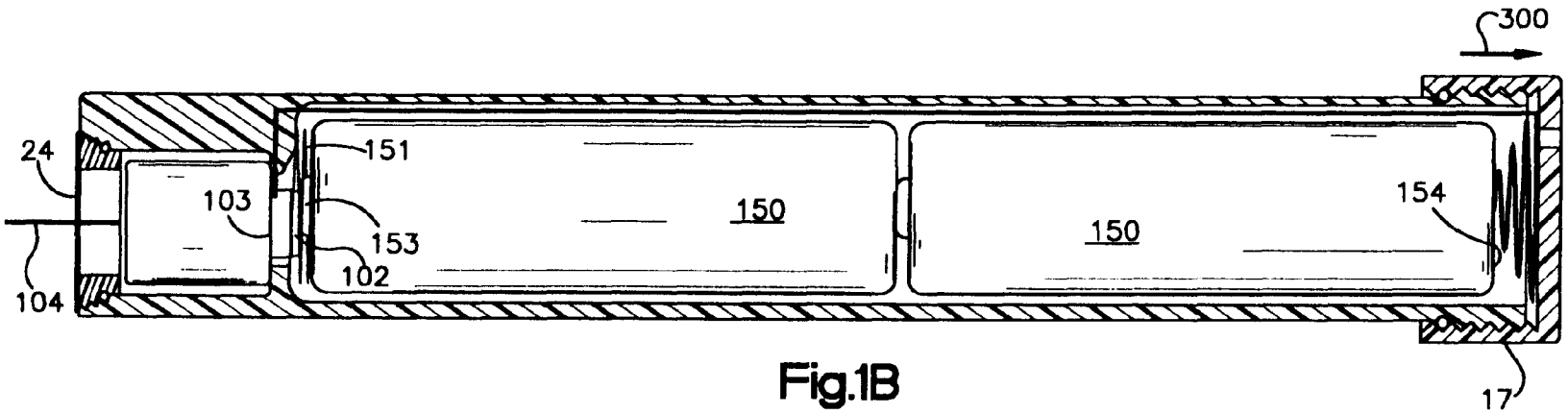
FIG. 1B illustrates a cut-away side view of the preferred embodiment of the laser light.

Referring now FIG. 1B, there is illustrated a cut-away side view of the assembled preferred embodiment of the laser light generally designated 10.

The assembled device 10 is shown in the on position. The laser emitting diodes second contact 103 is firmly against the front battery terminal 153. The rear battery terminal 154 is in contact with the rear contact spring which connects to the rear contact strip which is in contact with the laser emitting diodes first contact 102 thereby completing the circuit which provides current to the diode which produces the laser output 104. The laser output 104 exits the device 10 via the transparent lens 24. To stop the flow of current to the laser emitting diode 100 the end cap 17 may be rotated counter-clockwise which causes it to unscrew along the line of arrow 300 and release the compression on the front spacing spring 151 thereby breaking the contact between the front battery terminal 153 and the laser emitting diodes first contact 102.

Figure 2A:
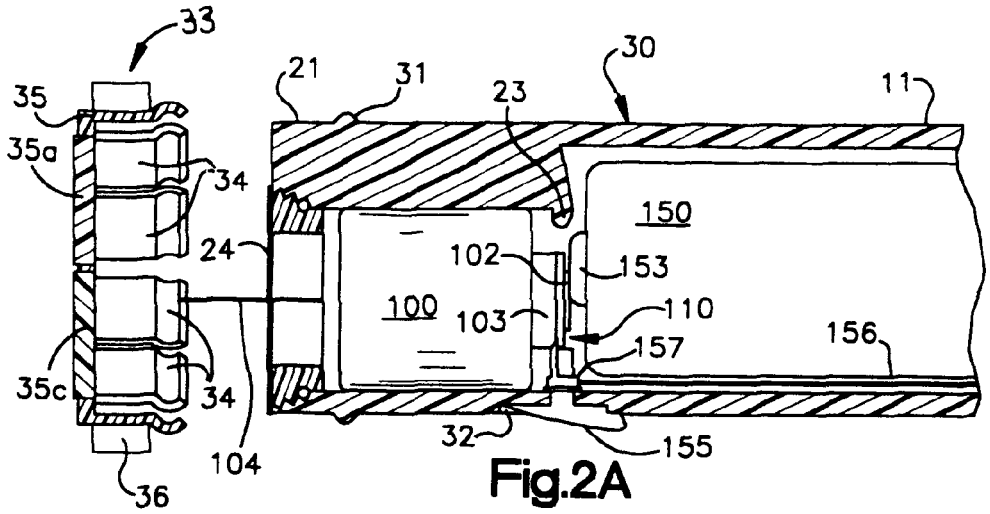
FIG. 2A illustrates a partial, cut-away side assembly view of an alternate embodiment of the laser light with overlens.

Referring now FIG. 2A, there is illustrated a cut-away partial side assembly view of an alternate embodiment of the laser light generally designated 30.

The device 30 is constructed around the tubular housing 11 of the preferred embodiment. Formed as part of the housing 11 are a plurality of overlens guides 31 and a momentary switch guide 32.

The interchangeable overlens assembly 33 rotatably snaps over the overlens guides 31 and encases the front of the laser light 21. A plurality of perpendicular legs 34 extending around the circumference of the overlens face 35 are of a size and shape which removably and rotatably snap over the overlens guides 31. The overlens face 35 is constructed of a material which allows the passage and shaping of the laser output 104. Within the face of the overlens 35 are a series of discreet lens elements 35*a* & 35*c*. The discreet elements are positioned in-line with the laser output 104 which, passes from the diode 100 through the transparent lens 24. Not shown is the complete simple electrical circuit supplying current to the diode which is known art.

The wavelength specific laser output 104 may be diffused or formed into a wide variety and type of shapes and patterns specific to the characteristics of the discreet elements, partially shown, 35*a* & 35*c*. The exact degree of pattern forming or diffusion of the output is dependent on the intended use.

Material choice for the discreet elements 35*a* & 35*c* include convex lenses, concave lenses, conical lenses, magnifying lenses, condensing lenses, Fresnel lenses, diffusion lenses, interference pattern generating gratings, cross-hair generator lens, straight line generator lenses, pattern generator lenses, diffractive pattern generators, holographic diffusers, optical diffusion glass, optical diffusion plastic, diffusion filters, circular diffusers, elliptical diffusers, off-axis lenses, off-axis holographic filters, or off-axis holographic diffusers all yield controllable and selectable results.

For the present device 30 a series of diffusion elements and pattern generating gratings form the parts of the overlens face 35. To cause the laser output 104 to pass through a selected discreet element the overlens 35 may be rotated around the overlens guides 31 in line with the laser output 104.

Within the roughly cylindrical housing 11 a solid state laser emitting diode 100 is removably affixed. Current from the batteries 150 is supplied to the laser emitting diode 100 via the diodes first 102 and second 103 conductive contacts both affixed to cylindrical contact neck 110. The front terminal of the battery 153 is in contact with the diodes first contact 102. A rotating momentary switch 155 is sealed within the switch guide 32 which traverses from the exterior to the interior of the device 30. Not shown is the rear of the device 30 and the rear terminal of the battery, the end cap, or the contact spring. The rear terminal of the batteries (not shown) is attached to the rotating momentary switch 155 via a conductive strip 156 which contacts the conductive member 157 of the rotating momentary switch 155. The conductive member can be rotated into contact with the diodes second contact 103 to complete a circuit. It is envisioned that other types of switches, momentary switches, spring loaded switches and locking switches well known in the art may be used.

Figure 2B:
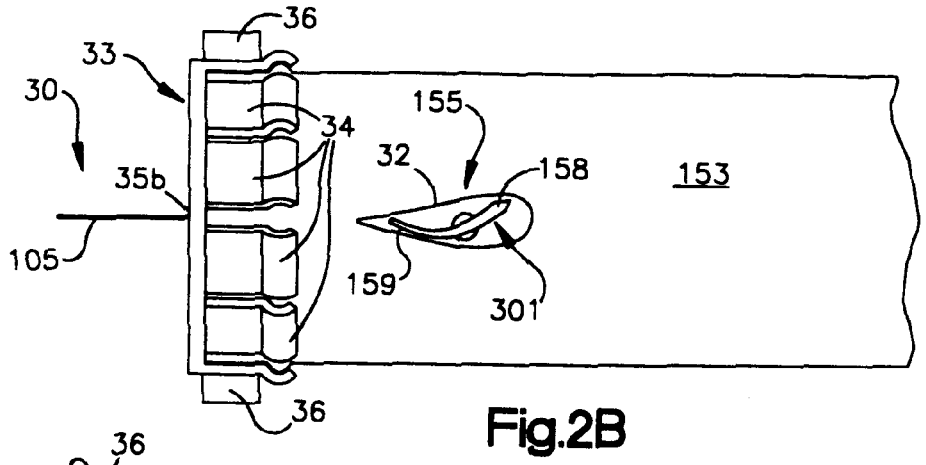
FIG. 2B illustrates a partial, top view of the embodiment of FIG. 2A assembled.

Referring now FIG. 2B, there is illustrated an assembled partial top view of the embodiment of FIG. 2A, generally designated 30.

The assembled device 30 is shown in the on position. The rotating momentary switch 155 is activated by pressure applied at the finger grip 158 along the line of arrow 301, the flexible spring end 159 is secured within the switch guide 32 and distorts in a reciprocal response to the pressure being applied. Not shown is the rotation of the conductive member 156 within the device 30 and the connection with the diodes second contact. When the pressure is released the flexible spring end 159 will undistorted and the rotating momentary switch 155 will return to the off position.

The enhanced laser output 105 is shown after its passage from the laser emitting diode 100 through a selected discreet element of the overlens 35*b*. To increase ease of rotation of the overlens for selecting a discreet element 35 ribs 36 may be extended from outer wall of one or more of the perpendicular legs 34.

Figure 2C:
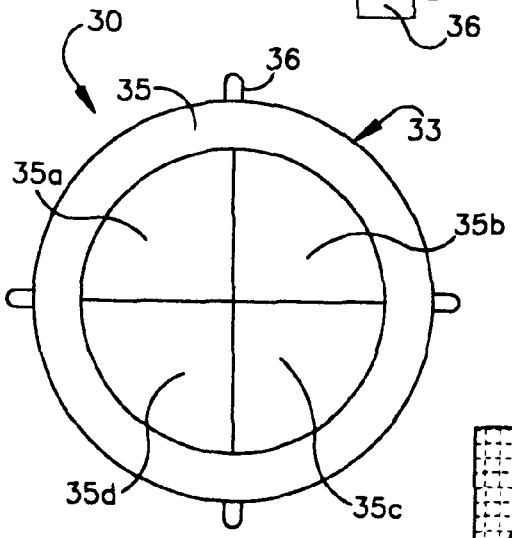
FIG. 2C illustrates a front view of FIG. 2B.

Referring now FIG. 2C, there is illustrated a front view of the embodiment of FIG. 2B generally designated 30.

The face 35 of the overlens 33 is divided into a plurality of discreet elements 35*a–d* and each element has distinct diffusion and pattern generating characteristics. The ribs 36 positioned around the overlens 33 provide for ease of griping and rotation.

Figure 2D:
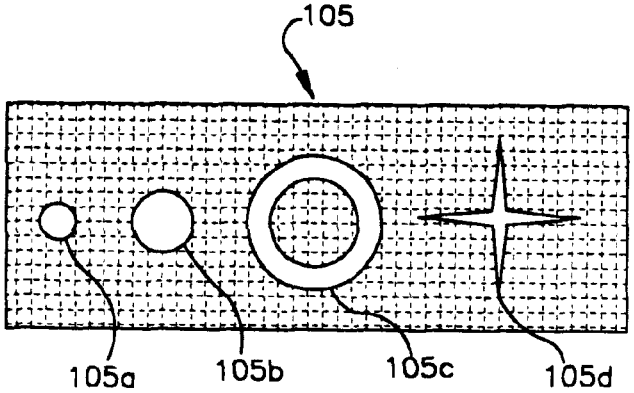
FIG. 2D illustrates a front view of the selectable output of FIG. 2C.

Referring now FIG. 2D, a front view of the selectable output of FIG. 2C, generally designated 105.

The small output 105*a* is a diffuse spot with a fan angle of between 0.1 and 1 degree. The large output 105*b* is a diffuse spot with a fan angle of between 1.01 and 5 degrees. The hoop output 105*c* is with a non-illuminated center results from passing the laser output 104 through a pattern generating grating. The cross hair output 105*d* also results from passing the laser output 104 through a pattern generating grating. The patterns shown are for illustration purposes only and are not intended to be a limitation on the possible patterns and pattern combinations which may be generated by the device 30.

Figures 3A, 3B, 3C:
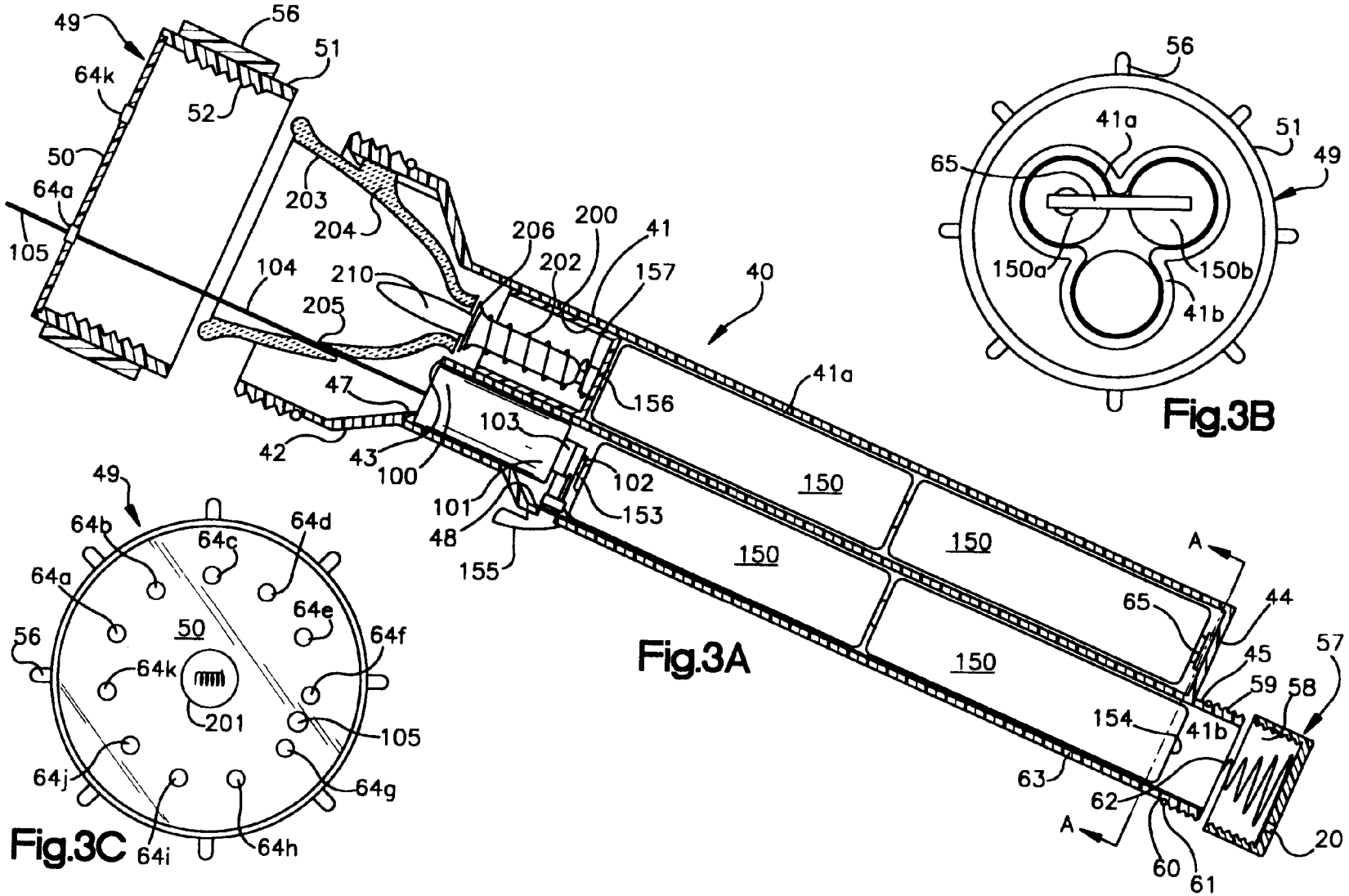
FIG. 3A illustrates a partial, cut-away side assembly view of the preferred embodiment of a wide spectrum flashlight with laser light.
FIG. 3B illustrates a cut-away rear view of the embodiment of FIG. 3A, at line A—A.
FIG. 3C illustrates a front view of the embodiment of FIG. 3A.

Referring now FIG. 3A, there is illustrated a cut-away side assembly view of the preferred embodiment of a laser flashlight generally designated 40.

The device 40 is constructed around the generally tubular housing 41, with an enlarged front 42 and an internal axial center divider 43, which divides the housing 41 into an upper chamber 41*a* and a lower chamber 41*b*. The upper chamber has a sealed rear end 44 and the lower chamber has an open rear end 45. Both upper and lower chambers merge into the enlarged front 42.

The upper chamber 41*a* contains the flashlight components, electrical circuit and batteries. The lower chamber 41*b* contains the laser components, electrical circuit and batteries.

The laser emitting diode 100 is readily available and is known art. The diode comprises a laser beam module with a control circuit. Since the laser emitting diode is well known in the art, it is unnecessary to present a detailed statement of its construction in the present invention.

For the preferred embodiment a laser emitting source in the visible range is used. The most compact source is a solid-state diode in the 532–690 nm range. Diode-pumped, CW diode, Q-switched diode, solid-state, solid-state CW, solid-state Q-switched, gas, dye, ion, or rare-earth element laser emitting sources may be used in place of the solid state diode when appropriate for the intended usage. For surveillance uses, search and rescue or other applications which use night vision or machine vision coupled with a non-visible spectrum illumination a laser emitting diode in the x-ray, ultraviolet or infrared spectrum may be substituted for the visible spectrum laser emitting diode.

For the light component construction of the laser flashlight a plurality of batteries 150, a light bulb guide 200, a light bulb 201, a spacer spring 202, and a reflector dish 203 are removably inserted the upper chamber 41*a* through the enlarged front 42. Formed as part of the reflector dish 203 is a stabilizer 204 which corresponds to the stabilizer guide slot 46 formed axially in the interior surface of the wall forming the enlarged front 42. The combination stabilizer 204 and stabilizer guide slot 46 restrict entry of the reflector dish 203 to one orientation and prevent rotation.

For the laser component construction of the laser flashlight, a laser emitting diode 100 is also mounted in the housing 41 through the enlarged front 42. The rear of the laser diode 101 is affixed into the lower chamber 41*b* via a flexible one-way locking tab 47 which extends perpendicular from the inner wall of the lower chamber 41*b* adjacent to the enlarged front 42. The one-way locking tab 47 will flex and distort to allow passage of the diode 100 into the lower chamber 41*b*. Once fully inserted the locking tab 47 will spring back and prevent the diode 100 from sliding forward.

To inhibit rearward movement of the laser emitting diode 100 a rotating momentary switch 155 is inserted and sealed within the switch guide 48 through the outer wall of the lower chamber 41*b* and behind the rear 101 of the laser emitting diode. The rotating momentary switch 155 is of a size and shape to both make positive contact with the diodes first and second set of conductive contacts 102 & 103 and restrict rearward movement of the diode.

A watertight and removable lens cover 49 is removably mounted over the enlarged front 42 of the housing 41 to seal the upper chamber and components. The lens cover 49 is cup shaped with a transparent planar face 50 and a annular circular wall 51 extends towards the enlarged front 42. The lens cover 49 is internally threaded with lens cover threads 52 corresponding to the externally threaded 53 enlarged front 42.

To create the watertight seal a large O-ring groove 54 is formed on the external surface of the enlarged front 42 and a large rubber or silicone O-ring 55 is affixed snugly within the large O-ring groove 54. The lens cover 49 is attached to the enlarge front 42 by screwing it on. To simplify rotation and prevent slippage of a hand on the lens cover 49 a plurality of raised ribs 56 are formed around the outer surface of the annular circular wall 51.

One or more batteries 150 supplying current to the laser emitting diode 100 are inserted through the open rear end 45 of the lower chamber 41*b*. The lower chamber is sealed by the lower chamber end cap 57 which has internal end cap threads 58 corresponding to the external housing threads 59 formed around the rear end 45 of the lower chamber 41*b*.

Also formed within the end cap 57 is a one-way pressure valve 20 which allows any gases generated by the batteries or diode to escape while preventing intrusion of water. A watertight seal is formed between the outer surface of the rear end 45 of the lower chamber 41*b* and the end cap 47 via a small O-ring groove 60 containing a small rubber or silicone O-ring 61. The lower chamber end cap 57 is attached by rotating it in a clockwise fashion over the rear end 45 of the lower chamber 41*b*.

The circuit supplying current to the diode is formed by screwing on the lower chamber end cap 57 which in-turn causes the conductive diode power spring 62 to contact with and urge the battery forward creating a positive contact between the diodes first contact 102 and the battery front terminal 153. To complete the circuit the conductive diode power strip 63 connects the rear battery terminal 154 with the rotating momentary switch 155.

The laser diode 100 may be activated independently or in concert with the light bulb 201. When active, the laser output 104 passes from behind the reflector dish 203 through a laser beam guide 205, of a size an orientation to allow unrestricted passage of the laser output 10, then through the transparent planar face 50 of the lens cover 49.

To generate an enhanced the laser output 105, formed as part of, or affixed to, the transparent planar face 50 are a plurality of discreet elements 64*a* & 64*k*. The discreet elements 64*a* & 64*k* are oriented in the planar face 50 so that they may be rotated in-line with the laser output 104.

The laser output 104 may be diffused and formed into a wide variety and type of shapes and patterns specific to the characteristics of the discreet elements 64*a* & 64*k*. The exact degree of pattern forming or diffusion of the output is dependent on the intended use. For the present device 40 a series of plastic diffusion elements and interference pattern generating gratings form the discreet elements 64*a* & 64*k*.

Material choice for the discreet elements 64*a* & 64*k* include convex lenses, concave lenses, conical lenses, magnifying lenses, condensing lenses, Fresnel lenses, diffusion lenses, interference pattern generating gratings, cross-hair generator lens, straight line generator lenses, pattern generator lenses, diffractive pattern generators, holographic diffusers, optical diffusion glass, optical diffusion plastic, diffusion filters, circular diffusers, elliptical diffusers, off-axis lenses, off-axis holographic filters, or off-axis holographic diffusers all yield controllable and selectable results.

The light bulb 201 in this embodiment is Xenon or Halogen gas filled, however, it is envisioned that other types of light sources all well known in the art may be used. In this embodiment four batteries placed parallel in rows of two are connected in series. A rear contact strip 65 affixed at the rear end of the upper chamber 41*a*. The flashlight battery positive terminal 156 and the negative terminal (not shown) abut the light bulb guide contacts 157. The simple pressure circuit is known art and is completed by urging the light bulb back within the light bulb guide 200 until it contacts with the positive and negative terminals. A spacer spring 202 surrounds the light bulb 201 and is compressed by the action of tightening the lens cover 49 onto the housing 41 which pushes the reflector dish 203 against the light bulb.

Referring now FIG. 3B, there is illustrated a rear cut away, along line A—A, view of the embodiment of FIG. 3A, generally designated 40.

Within the upper chamber 41*a* are the two ends 150*a* & 150*b* of the two rows of batteries powering the flashlight are connected at the rear via the rear contact strip 65.

The plurality of raised ribs 56 are evenly spaced around the outer surface of the annular circular wall 51 to enhance ease of rotation of the lens cover 49.

Referring now FIG. 2C, there is illustrated a front view of the embodiment of FIG. 3A generally designated 40.

Formed within the planar face 50 are a plurality of discreet elements 64*a* & 64*k*. Between each discreet element 64*a* & 64*k* is the transparent planar face 50 material which allows the un-enhance laser output 104 to pass from the device. When used in concert, the light bulb 201 produces a generalized wide spectrum illumination and the laser output, exiting the housing through the laser beam guide 205, produces the precise shaped pattern or pin-point illumination within the area of generalized illumination.

Since certain changes may be made in the above apparatus without departing from the scope of the invention herein involved, it is intended that all matter contained in the above description, as shown in the accompanying drawing, shall be interpreted in an illustrative, and not a limiting sense.

What is claimed is:

1. A hand held submersible laser light, adapted for underwater use, comprising:

(a) a hollow elongated casing having an open front and rear end and being substantially circular in cross-section with a outwardly protruding cylindrical neck forming a clear cover receiving front end and a cylindrical end cap receiving back end;

(b) a laser emitting source, with drive circuitry of a size and shape to mount removably within said hollow elongated casing;

(c) a negative and positive electrical terminal affixed on a contact neck affixed to, and protruding rearward from, said laser emitting source;

(d) a substantially collimated laser illumination emitted by said laser emitting source;

(e) a clear cover which mates with said clear cover receiving front end;

(f) a end cap which mates with said end cap receiving back end;

(g) a sealant means disposed between said clear cover receiving front end and said clear cover and between said end cap receiving back end and said end cap for providing a watertight seal between said clear cover receiving front end and said clear cover and between said end cap receiving back end and said end cap;

(h) a series of one or more batteries inserted into said hollow elongated body; and, (i) a connection means for electrically connecting said contact neck to said batteries.

2. The laser light according to claim 1, wherein said outwardly protruding cylindrical neck includes internal threads formed adjacent to said open front end and said clear cover has externally formed mating threads for mating with said neck threads.

3. The laser light according to claim 1, wherein said back end includes external threads formed adjacent to said open back end and said end cap has internally formed mating threads for mating with said back end threads.

4. The laser light according to claim 1, wherein said sealant means comprises one or more silicone or rubber O-rings.

5. The laser light according to claim 1, wherein said means for electrically connecting comprises:

(a) a manually operable means for telescopically moving said batteries along a longitudinal axis of said hollow casing; and, (b) a contact means responsive to the position of said batteries for selectively electrically coupling said contact neck to said batteries within said casing.

6. The laser light according to claim 5, wherein said contact means is a conductive spring affixed to the internal wall of said end cap and attached to a axial conductive strip electrically connected to said negative electrical terminal affixed on said contact neck and said manually operable means for telescopically moving said batteries for electrically coupling to said laser emitting sources positive electrical terminal is the clockwise rotation of said end cap on said open back end.

7. The laser light according to claim 1, wherein said connection means comprises:

(a) a momentary pressure switch mounted through said casing with a depressible external head actuated via depressing said external head; and, (b) an internal contact responsive to the position of said external head.

8. The laser light according to claim 1, wherein said electrical connection means is selected from the group of on/off switches consisting of momentary, push button, pressure sensitive, rotating, rotating momentary, variable resistance switches consisting of rotating, pressure sensitive, or momentary rotating.

9. The laser light according to claim 1, further comprising a one-way watertight venting valve for gas elimination.

10. The laser light according to claim 1, further comprising a replaceable hydrogen catalyst for gas elimination.

11. The laser light according to claim 1, wherein said laser emitting source is selected from the group consisting of diode-pumped, CW diode, Q-switched diode, solid-state, solid-state CW, solid-state Q-switched, gas, gas and metal, ion, dye, or rare-earth element lasers,

12. A hand held submersible laser light, adapted for underwater use, comprising:

(a) a hollow elongated casing having an open front and rear end and being substantially circular in cross-section with a outwardly protruding cylindrical neck forming a clear cover receiving front end and a cylindrical end cap receiving back end;

(b) one or more laser emitting sources with drive circuitry and positive and negative electrical terminals;

(c) a laser source positioning guide formed within said hollow elongated casing to affix said laser emitting source within said hollow elongated casing in a fixed orientation;

(d) a substantially collimated laser illumination emitted by each of said laser emitting sources;

(e) a clear cover which mates with said clear cover receiving front end;

(f) a overlens housing with a transparent front of a size and shape to cover said clear face;

(g) a plurality of flexible perpendicular legs, extending in one direction, around said overlens of a size and shape to fit snugly over said front end of said hollow casing yet allow for rotation and removal of said overlens;

(h) a gripping surface of ribs formed around the circumference of said overlens housing;

(i) a optical means formed within said overlens for altering said collimated laser illumination;

(j) a end cap which mates with said end cap receiving back end;

(k) a sealant means disposed between said clear cover receiving front end and said clear cover and between said end cap receiving back end and said end cap for providing a watertight seal between said clear cover receiving front end and said clear cover and between said end cap receiving back end and said end cap;

(l) a series of one or more batteries inserted into said hollow elongated body;

(m) a connection means for electrically connecting said laser emitting source to said batteries; and, (n) a one-way watertight venting valve for gas elimination.

13. The laser light according to claim 12, wherein said optical means is selected from the group consisting of convex lenses, concave lenses, conical lenses, magnifying lenses, condensing lenses, Fresnel lenses, diffusion lenses, interference pattern generating gratings, cross-hair generator lens, straight line generator lenses, pattern generator lenses, diffractive pattern generators, holographic diffusers, optical diffusion glass, optical diffusion plastic, diffusion filters, circular diffusers, elliptical diffusers, off-axis lenses, off-axis holographic filters, or off-axis holographic diffusers.

14. The laser light according to claim 12, wherein said electrical connection means is selected from the group of on/off switches consisting of momentary, push button, pressure sensitive, rotating, rotating momentary, variable resistance switches consisting of rotating, pressure sensitive, or momentary rotating.

15. The laser light according to claim 12, wherein each of said laser emitting sources is selected from the group consisting of diode-pumped, CW diode, Q-switched diode, solid-state, solid-state CW, solid-state Q-switched, gas, gas and metal, ion, dye, or rare-earth element lasers.

16. The laser light according to claim 12, further comprising:

(a) a plurality of overlens rotation catches formed on the exterior of the front end surface of said hollow elongated casing; and, (b) a plurality of overlens rotation latches formed on said flexible perpendicular leg which mate with said overlens rotation catches whereby said overlens is affixed to said elongated casing.

17. A hand held laser flashlight, comprising:

(a) a hollow elongated casing having an open front and a partially sealed rear and being substantially oval in cross-section with an internal wall bisecting a portion of the casing axially into upper and lower internal chambers which connect internally at the outwardly protruding enlarged cylindrical neck forming a front cover receiving head, said upper chamber having a sealed back end and said lower chamber having an open back end with a protruding cylindrical end cap receiving rear end, a diode receiving front end of said lower chamber, said upper and lower chambers are each of a size and shape for receiving one or more batteries;

(b) a illumination means mounted within said upper chamber for receiving electrical power from said batteries and for generating light;

(c) one or more laser emitting sources with a drive circuit and positive and negative electrical terminals of a size and shape to fit within said lower chamber;

(d) a substantially collimated laser illumination emitted by said laser emitting source;

(e) a wide spectrum light emitted by said illumination means;

(f) a transparent front cover which mates with said front cover receiving head through which said laser illumination and said wide spectrum light pass;

(g) a end cap which mates with said end cap receiving rear end; and, (h) a connection means for electrically connecting said illumination means and said laser emitting source to said batteries.

18. The laser flashlight according to claim 17, wherein said laser emitting source is selected from the group consisting of diode-pumped, CW diode, Q-switched diode, solid-state, solid-state CW, solid-state Q-switched, gas, gas and metal, ion, dye, or rare-earth element lasers.

19. The laser flashlight according to claim 17, wherein said connection means for electrically connecting said illumination means and said laser emitting source to said batteries further comprises;

(a) two or more separate series of batteries;

(b) a first switch for electrically connecting said illumination means to one series of said batteries; and, (c) a second switch for electrically connecting said laser emitting diode to another series of said batteries.

20. The laser flashlight according to claim 19, wherein said first and second switches are selected from the group of on/off switches consisting of momentary, push button, pressure sensitive, rotating, rotating momentary, variable resistance switches consisting of rotating, pressure sensitive, or momentary rotating.

21. The laser flashlight according to claim 17, wherein said illumination means comprises:

(a) a light bulb;

(b) a cylindrical reflecting dish having a substantially parabolic reflecting surface with a central light bulb guide mounted adjacent to said enlarged head within said neck facing said transparent front cover; and, (c) a light bulb contact guide for mounting said light bulb with electrical contacts formed thereon to connect with said first switch, which is positioned through said light bulb guide in said reflecting dish which holds said light bulb in place.

22. The laser flashlight according to claim 21, wherein said light bulb is selected from the group consisting of Halide bulbs, Xenon bulbs, Krypton bulbs, or Tungsten bulbs.

23. The laser flashlight according to claim 21, further comprising:

(a) a laser output guide formed within said cylindrical reflecting dish for allowing said laser illumination to pass from behind said reflecting dish in-line and through said transparent front cover;

(b) one or more alignment channels formed axially along the interior surface of said enlarged head; and, (c) one or more alignment guides formed on said reflecting dish, corresponding to said alignment channels, which restrict the rotational movement of said reflecting dish and allow for linear forward and backward movement of said reflecting dish within said neck while maintaining alignment between said laser illumination and said laser output guide.

24. The laser flashlight according to claim 21, wherein said first switch is a manually operable means for telescopically moving and electrically coupling said light bulb along a longitudinal axis of said elongated casing and in contact with one series of said batteries.

25. The laser flashlight according to claim 24, wherein said manually operable telescoping means comprises:

(a) a plurality of external head threads formed adjacent to said front cover receiving head;

(b) a plurality of internal mating threads within said transparent front cover for mating with said external head threads;

(c) a latch formed on the reflecting dish adjacent to said bulb guide and a corresponding catch formed on said light bulbs conductive base whereby the mating of said transparent front cover causes said reflecting dish to be urged linearly within said neck and said latches urges said catches and said light bulb against said coil spring whereby said light bulb is electrically connected, via said linear movement, to said series of batteries; and, (d) a gripping surface of large ribs formed around the circumference of said transparent front cover for ease of rotation of said transparent front cover.

26. The laser flashlight according to claim 25, further comprising a plurality of small discreet optical elements, each an optical means for altering said laser illumination, formed within or affixed to said transparent front cover and positioned whereby rotating said transparent front cover on said mating threads positions a selected one of said discreet optical elements in the path of said laser illumination.

27. The laser flashlight according to claim 23, further comprising:

(a) a plurality of overlens rotation guides formed on the exterior surface of said transparent front cover;

(b) a overlens housing with a transparent front of a size and shape to fit over said transparent front cover (c) a plurality of flexible perpendicular legs, extending in one direction, around said overlens of a size and shape to fit snugly over said transparent front cover and said overlens rotation guides which allow the removal and rotation of said overlens housing;

(d) a gripping surface of ribs formed around the circumference of said overlens housing; and, (e) a series of small discreet optical means formed within said overlens, in-line with said lase illumination, for altering said collimated laser illumination.

28. The flashlight and laser light according to claim 27, wherein each small discreet optical element is selected from the group consisting of convex lenses, concave lenses, conical lenses, magnifying lenses, condensing lenses, Fresnel lenses, diffusion lenses, interference pattern generating gratings, cross-hair generator lens, straight line generator lenses, pattern generator lenses, diffractive pattern generators, holographic diffusers, optical diffusion glass, optical diffusion plastic, diffusion filters, circular diffusers, elliptical diffusers, off-axis lenses, off-axis holographic filters, or off-axis holographic diffusers.

29. A laser flashlight, according to claim 17, adapted for wet environment and underwater use further comprising:

(a) a silicone or rubber O-ring disposed between said front cover receiving head and said transparent front cover and a silicone or rubber O-ring disposed between said end cap receiving rear end and said end cap whereby a watertight seal is formed between said clear cover receiving front end and said clear cover, and between said end cap receiving rear end and said end cap; and, (b) a gas elimination means.

* * * * *